United States Patent [19]

Palau

[11] 3,961,649

[45] June 8, 1976

[54] HEDDLE FRAME ARRANGEMENT FOR A WEAVING MACHINE

[75] Inventor: Joseph Palau, Haute-Savoie, France

[73] Assignee: Staeubli, Ltd., Horgen-Zurich, Switzerland

[22] Filed: Apr. 7, 1975

[21] Appl. No.: 565,393

[30] Foreign Application Priority Data

Apr. 9, 1974 Switzerland ..... 4973/74

[52] U.S. Cl. ..... 139/82; 139/91; 139/93

[51] Int. Cl.[2] ..... D03C 13/00; D03C 9/00; D03C 9/02

[58] Field of Search ..... 139/82, 83, 85, 90, 139/91–96, 368

[56] References Cited

UNITED STATES PATENTS

| | | | |
|---|---|---|---|
| 795,368 | 7/1905 | Renkel | 139/91 |
| 2,510,404 | 6/1950 | Lake et al. | 139/82 |
| 3,230,983 | 1/1966 | Egli | 139/82 |
| 3,236,264 | 2/1966 | Strach | 139/90 X |
| 3,796,235 | 3/1974 | Müller | 139/82 X |
| 3,834,426 | 9/1974 | Müller | 139/85 |

FOREIGN PATENTS OR APPLICATIONS

| | | | |
|---|---|---|---|
| 49,678 | 11/1889 | Germany | 139/93 |
| 47-34,677 | 8/1972 | Japan | 139/82 |
| 850,138 | 9/1960 | United Kingdom | 139/90 |
| 991,051 | 5/1965 | United Kingdom | 139/90 |
| 257,737 | 9/1926 | United Kingdom | 139/90 |

*Primary Examiner*—James Kee Chi

*Attorney, Agent, or Firm*—Woodhams, Blanchard and Flynn

[57] ABSTRACT

A heddle frame arrangement for a weaving machine having freely suspended heddles for a fast-running weaving machine.

The upper bar and the lower bar of the frame are movable parallel to one another, so that not the entire frame must participate in the up and down movement. The heddles which are suspended on the movable bar each have, for balancing the movement, an elastic part.

17 Claims, 10 Drawing Figures

HEDDLE FRAME ARRANGEMENT FOR A WEAVING MACHINE

The invention relates to a weaving machine having a shed-forming machine or a dobby and frames having heddles thereon for guiding the warp threads, which frames are controlled through frame draw members which engage the frame bar on which the heddles are secured at either their upper or lower ends.

BACKGROUND OF THE INVENTION

A dobby which is connected to a weaving machine controls on one side patternlike the final position of the frames on the weaving machine, however, it must on the other side also develop the forces to move the controlled or read-in frames from one position, for example the lower shed, into another position, for example the upper shed. Many forces must be overcome thereby, which in turn depend partly on the speed of the frame or rotational speed of the weaving machine.

The most important one of these forces is the force for overcoming the mass acceleration of a complete frame and, in the spring release weaving machines, the force for overcoming the draw-back forces which engage the frame, thus spring force plus resistance and weight of the moved frame and spring parts. These forces could be reduced, if on the one hand the weight and on the other hand the force of the spring could be reduced.

A reduction of the weight of the entire frame is generally not desired because the solidity and rigidity of the frame is not to suffer under such a reduction. The frame must be built so strong that it can receive, without any large deformation, the forces which act up on it.

The purpose of the invention is to reduce the forces which are exerted as a reaction by the frame against the draw members.

This is attained inventively in a weaving machine of the above-mentioned type by having elastically expandable, pretensioned draw means engage the end of each heddle for reducing the moved frame mass, the lower end of which draw means is anchored on an abutment.

With this two force reductions can be achieved, namely on the one hand the entire weight of the frame can be reduced considerably without the danger of a reduction in the stability of the frame and on the other hand the operating members only overcome the effective spring force. A further advantage lies in the operational clearance between the heddles and the frame being overcome by the individual springs, namely the heddles stay with the braking movement of the frame. Shocks of the heddles during braking do not occur.

BRIEF DESCRIPTION OF THE DRAWINGS

Exemplary embodiments of the subject matter of the invention are illustrated in the drawings, in which.

DETAILED DESCRIPTION

Figure 1:
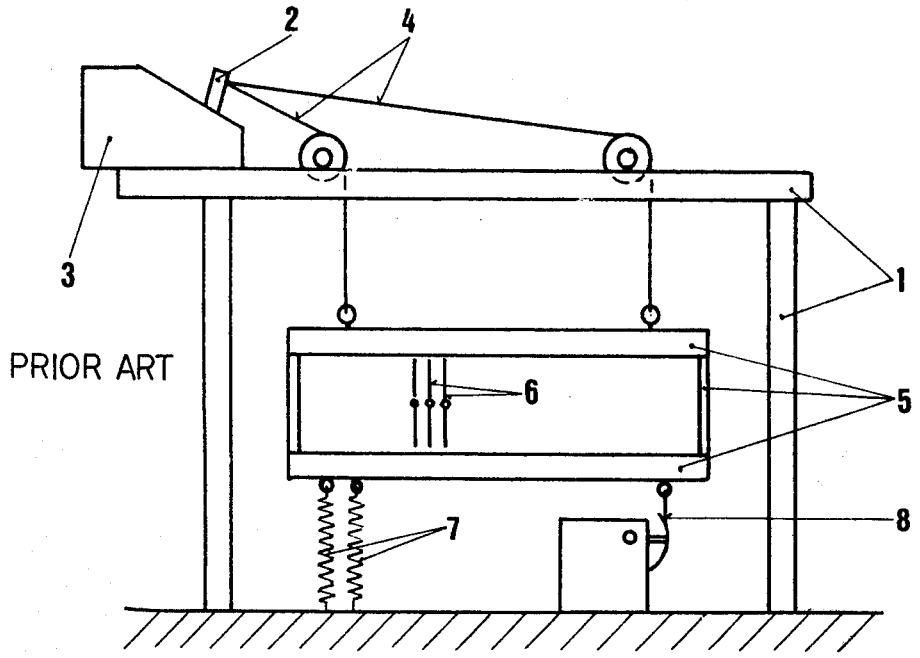
FIG. 1 is a schematic illustration of a conventional weaving machine having a spring release.

FIG. 1 illustrates a known weaving machine frame 1. A heddle frame 5 is controlled by the frame draw members 4 secured to a lever 2 of a shed-forming machine or dobby 3. Heddles 6 are arranged in the heddle frame. Springs 7 or spring draw registers 8 engage the heddle frame to hold the frame under tension, so that a frame formerly lifted by the dobby is again moved patternlike into the lower-shed position. In this known construction, the spring return force must control the entire frame.

Figure 2:
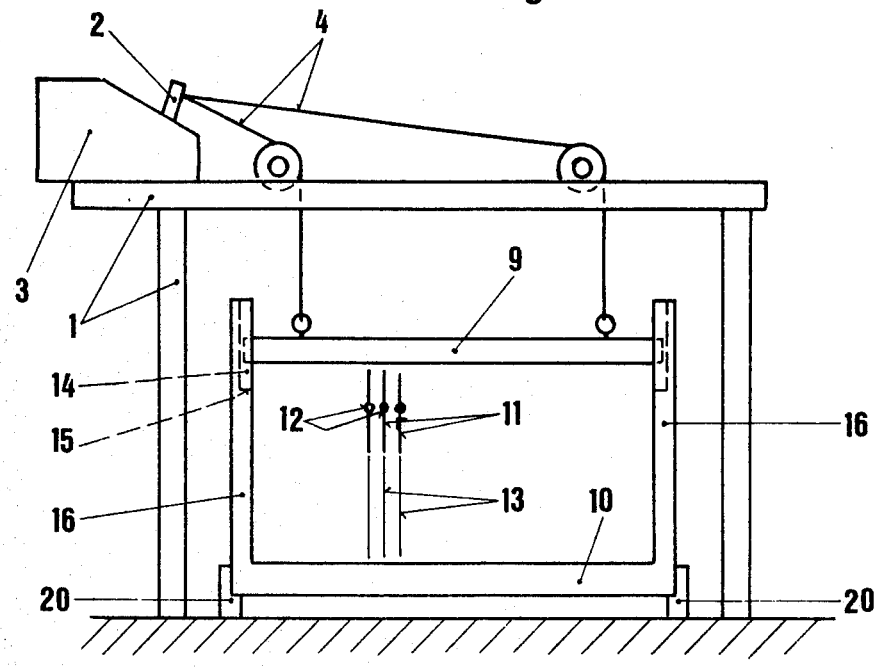
FIG. 2 is a schematic illustration of an inventive weaving machine having a spring release.

FIG. 2 illustrates the same weaving machine having a frame which has inventively been moved upwardly half way. The upper bar 9 is moved up by the pull of the frame draw members 4 and released, causing the heddles 11, which are suspended thereon, to lift the warp threads which are carried in their eyelets 12 into the upper-shed position. Each heddle is connected at the lower end to a spring 13 which may for example be a rubber cord. The free end of the spring is connected to the weaving machine frame or to the nonmovable abutment 10 of the frame so that an initial stress remains in the lower-shed position of the upper bar 9 which is sufficient to move the warp thread into the lower-shed position at least through the associated heddle. The movable upper bar 9 is guided at the lateral ends in guideways 14 in the vertical bars 16 which are fixedly connected to the abutment 10 for maintaining the frame pitch. The frame 9 engages a stop 15 in the guideway 14 when the frame 9 is released from the pull of the draw members 4.

Figure 4:
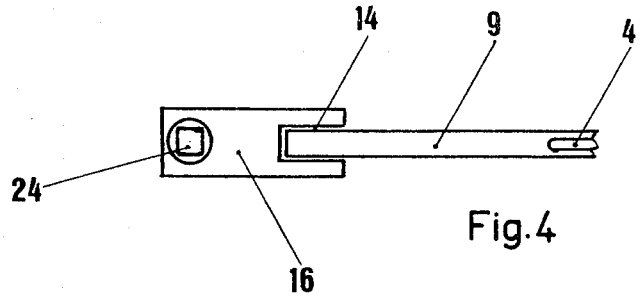
FIG. 4 is a top view of this frame portion.
Figure 5:
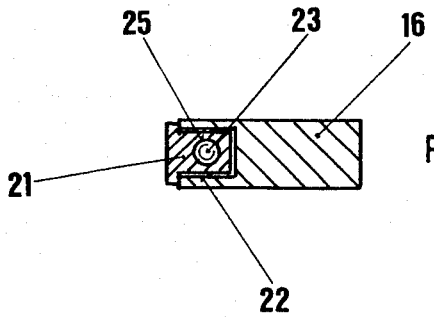
FIG. 5 is a cross-sectional view taken along the line V—V of FIG. 3.
Figure 6:
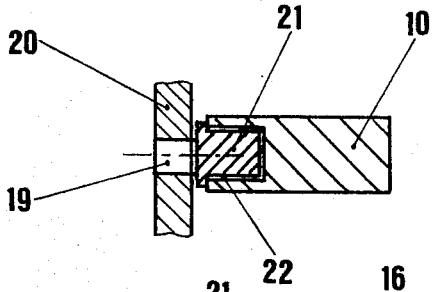
FIG. 6 is a cross-sectional view along the line VI-VI of FIG. 3.
Figure 7:
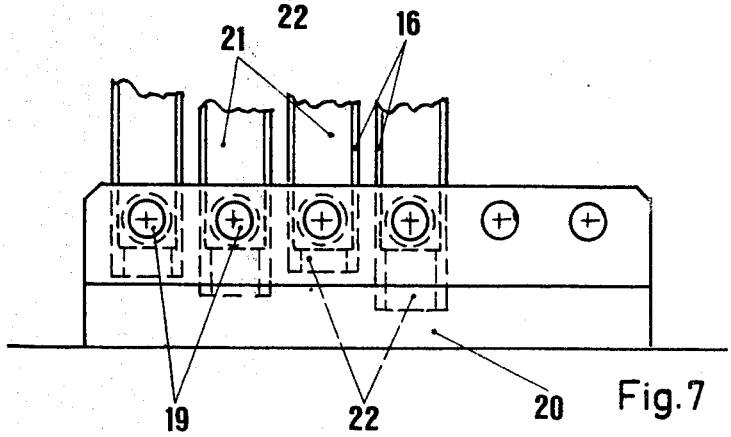
FIG. 7 is a front view along the arrow VII in FIG. 3 of an arrangement having several frames.

When the upper bar 9 engages the stop 15, the springs 13 still are under an initial stress. The abutment 10 is held in the retaining members 20, which in turn are secured to the weaving machine frame 1 or to the floor. The upper bars 9 of various adjacent frames can each be guided in a separate fixed frame part 10, 16 or in one frame with several guideways 14. The guideways can, as is shown in FIG. 4, be constructed as a groove.

Figure 3:
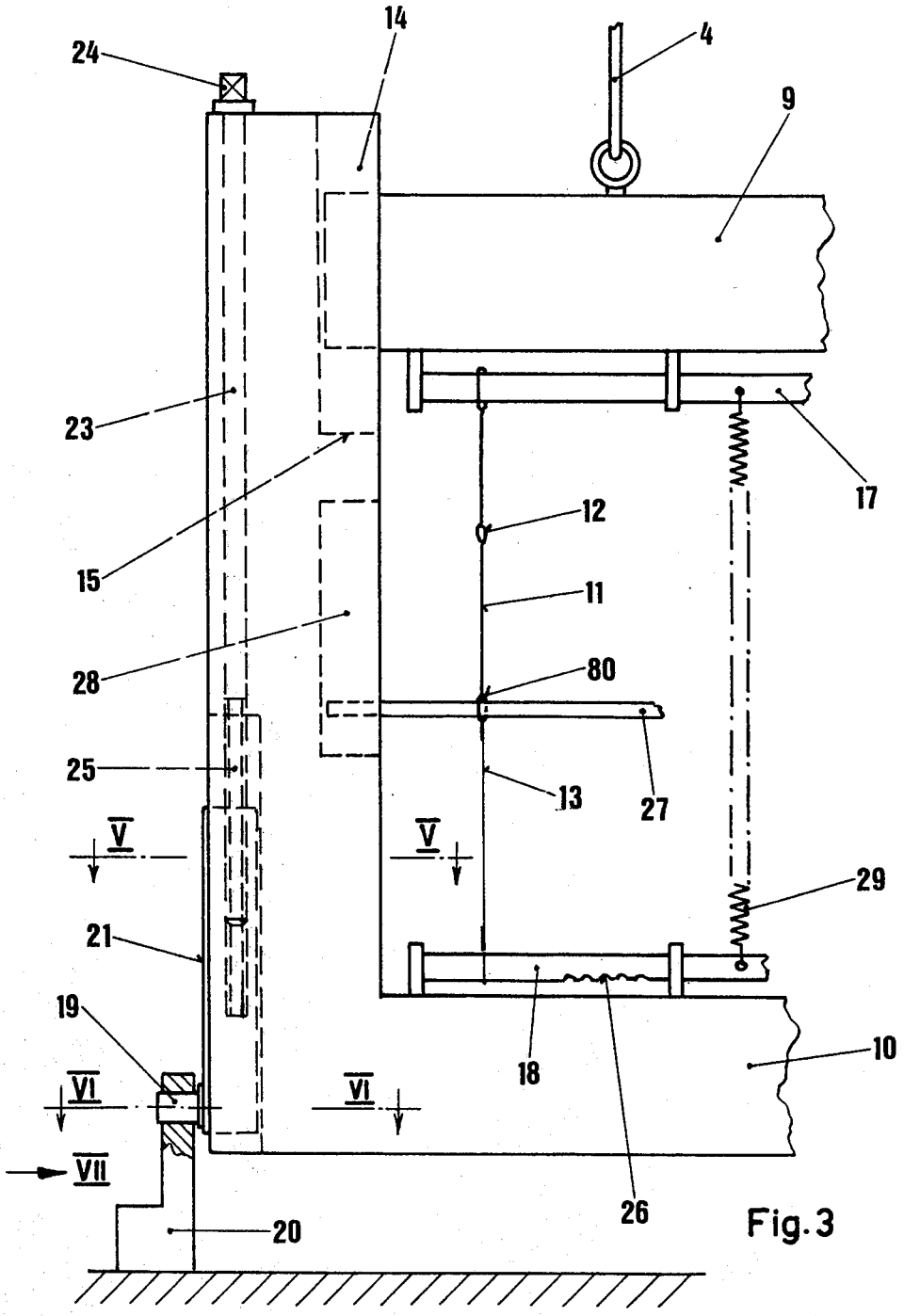
FIG. 3 illustrates in an enlarged scale the left portion of a heddle frame.

One can recognize from FIG. 3, that the movable upper bar 9 carries the heddles 11 directly therewith or by means of a known threading-on rail 17. The spring 13, which is connected in a conventional manner to the lower part of the heddle, is secured directly or, as illustrated, through a bar 18 to the fixed abutment 10.

The abutment 10 with the lateral guide bar 16, which form together the U-shaped frame part which is nonmovable in elevational direction, are anchored pivotally through the pivot bolt 19 in the bearing 20, which permits the operator to spread apart in a conventional manner the upper parts of two adjacent heddle frames, if he wants to repair a warp thread therebetween. In a special construction, the bolt 19 is part of a slider 21, which is guided in a groove 22. An easily accessible regulating screw 23 has a head 24 which engages the vertical guide bar 16 and threadedly engages with its thread 25 the thread of the slider 21. This connection permits an adjustment of the fixed frame part 10, 16 in its vertical height relative to the bearing 20 secured to the weaving machine frame 1 or to the floor and relative to the movable upper bar 9. As a result, the tension of all springs 13 of one frame can, at the same time, be easily adjusted, which may for example be necessary when the type of warp thread is being changed. In addition, the screw can be removed completely from the slider 21, the entire frame, consisting of the parts 9, 10, 11, 13 and 16 and can be removed from the weaving machine.

The threading-on rail 18 may have weak or strong teeth 26, which makes movement of the springs 13 difficult or impossible.

One can easily see from the illustrations, that a considerable part of the heddle frame 10, 16 is not moved either by the dobby or by the springs. Thus the strength of all springs 13 may lie below the strength of the conventional springs 7 or 8 (FIG. 1), which in turn is expressed in a lighter design construction of the moved bar 9. A further weight reduction of the moved parts is due to the fact that rubber, polyurethane or Lycra, etc. can be used for the spring cord 13, the spring weight of which is less with respect to the spring work than in the case of springs made of steel. Particularly in the case of specially light articles, where the down-pulling force of the springs may be small, there exists the possibility to connect two or more heddles with one and the same spring 13, so that therewith weight can also be saved. In as far as the spring force must be increased for individual heddles, for example edge heddles, it is possible to have several spring cords 13 engage one heddle 11. If the pulling-down force on the upper bar 9 is increased additionally without any stress on the heddles, an additional spring 29 can be mounted between the upper bar 9 and the abutment 10. In place of the additional spring 29 it is possible to arrange blind heddles, namely heddles which have no warp threads threaded therein, with light tension springs 13 between the normal heddles.

Under certain circumstances, the danger could exist that the lower ends of the heddles 11, which are each connected to the springs 13, swing out too far to the side. This can be prevented by inserting a rod 27 through the lower eyelets 80 of the heddles 11. A special guideway 28 is provided for this rod in the side bar 16. This rod prevents at the same time an easy rotation of the heddles, which can be released by special warp threads.

Figure 8:
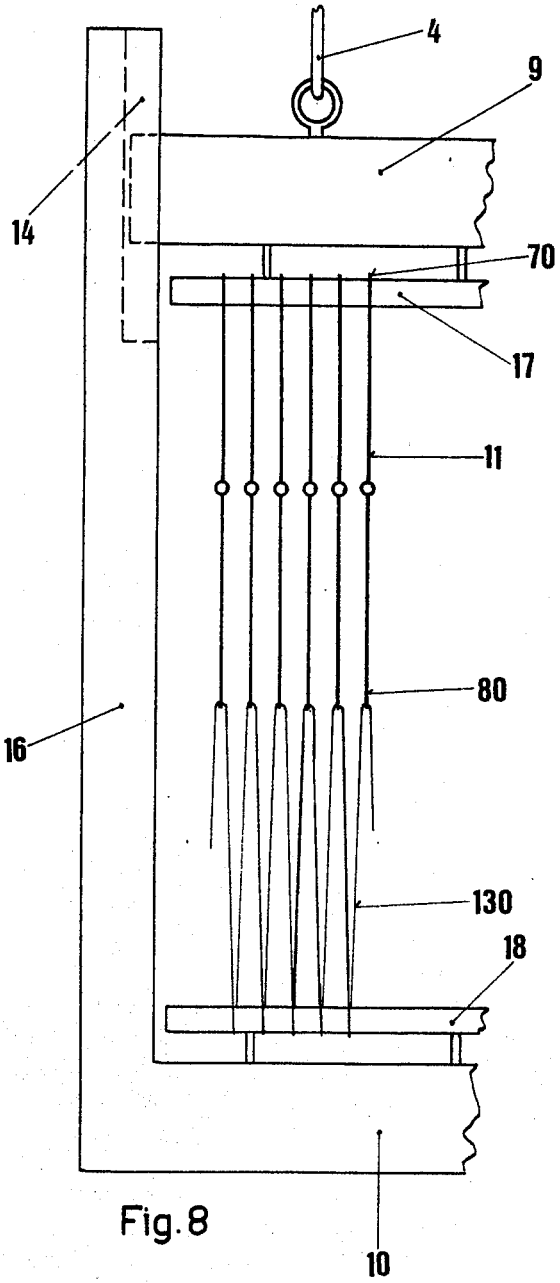
FIG. 8 is a modified embodiment in the illustration of FIG. 3, FIGS. 9 and 10 are two detailed illustrations of this modified embodiment.
Figure 9:
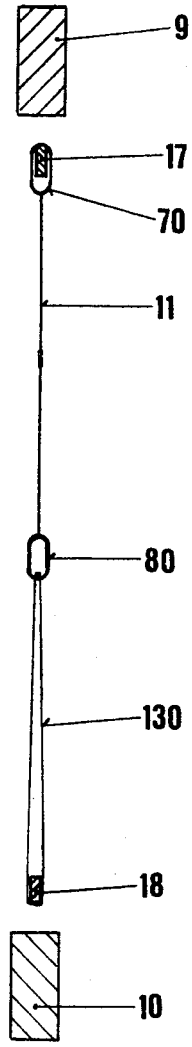
Figure 10:
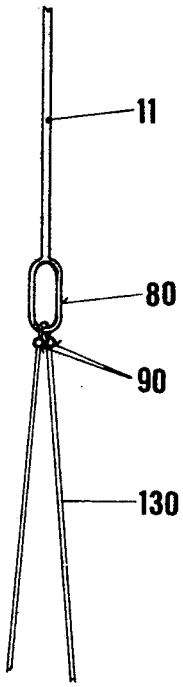

A further modified embodiment is illustrated in FIGS. 8 to 10, whereby the same parts have the same reference numerals. The fixed frame part consists of the side bar 16 and the abutment 10 having a threading-in rail 18 mounted thereon. The movable frame part is illustrated by the upper bar 9 having the draw member 4 and the threading-in rail 17 secured thereto, whereby the ends of upper bar 9 are received in the guideway 14. The heddles 11 are arranged with their upper eyelets 70 loosely looped around the rail 17. A cord 130 of a resilient material, for example rubber, is pulled through the lower eyelet 80 or hook, which cord 130 is drawn zigzagged back and forth between adjacent eyelets 80 and the rail 18. This avoids the complicated securement of individual spring cords 13 on the individual heddles 11. However, in order to still achieve an even spring effect in the embodiment illustrated in FIGS. 8 to 10, prefabricated knots 90 (FIG. 10) may be arranged in the cord 130 before and after the eyelet 80.

Of course it is not necessary that the tension springs 13, 130 engaging the heddles 11 are arranged on the bottom. The movable upper bar 9 may also be mounted on the bottom in the weaving machine, the abutment 10 on the top so that the heddles are on the bottom and the draw cords on the top.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A heddle frame arrangement for a weaving machine, comprising:

a base;

a frame secured to said base, said frame consisting of a pair of horizontally spaced and parallel side members and an abutment member, said side members and abutment member defining a plane;

vertically aligned guide means mounted on said side members;

a horizontally aligned and vertically movable bar extending between said side members, the ends of said horizontally aligned bar cooperating with said vertically aligned guide means to maintain a coplanar relationship thereof to said plane of said frame;

at least one heddle secured at one end to said horizontally aligned bar and having an eyelet therein for receiving a warp thread;

first securement means on an end of said heddle remote from said end secured to said bar; and resilient means secured to and extending between said first securement means and said abutment means to resiliently hold said heddle taut and at least assisting in urging said horizontally aligned bar toward the lowermost position thereof.

2. A heddle frame arrangement according to claim 1, wherein said resilient means is a low mass spring.

3. A heddle frame arrangement according to claim 1, wherein said resilient means includes at least one rubber cord.

4. A heddle frame arrangement according to claim 1, wherein at least one resilient means is secured to each of said first securement means.

5. A heddle frame arrangement according to claim 2, wherein a plurality of said first securement means are each connected to one and the same spring.

6. A heddle frame arrangement according to claim 1, wherein said abutment member is secured to said side members and cannot be moved in vertical direction.

7. A heddle frame arrangement according to claim 1, including a plurality of parallel frames and wherein each horizontally aligned bar is guided parallel with respect to each other in said vertically aligned guide means.

8. A heddle frame arrangement according to claim 1, including stop means for limiting the lowermost position of movement of said bar.

9. A heddle frame arrangement according to claim 8, wherein said side members are vertical;

wherein said stop means are arranged on said vertical side members of said frame.

10. A heddle frame arrangement according to claim 9, wherein said frame is U-shaped;

wherein said bar and said U-shaped frame form a closed heddle frame mounted in said weaving machine.

11. A heddle frame arrangement according to claim 10, including pivot means for pivotally securing said U-shaped frame about a horizontal axis to said base.

12. A heddle frame arrangement according to claim 11, wherein said pivot means includes a pair of vertically adjustable pivot pins for forming a pivot axis, each of said pivot pins being mounted on said frame.

13. A heddle frame arrangement according to claim 12, wherein said pivot means includes a slider for each pivot pin;

wherein each pivot pin is mounted on one of said sliders;

wherein said pivot means further includes adjusting means cooperable with said sliders to effect a vertical adjustment of said sliders and the associated pivot pin.

14. A heddle frame arrangement according to claim 13, wherein said side members each have a vertical opening therethrough; and wherein said adjusting means includes a threaded bolt in each of said side members with one end of said bolt being free for engagement with a tool.

15. A heddle frame arrangement according to claim 1, wherein said resilient means is an elastically expandable continuous cord suspended zigzagged between the lower ends of said heddles and said abutment member.

16. A heddle frame arrangement according to claim 15, including knots in said continuous cord to secure said cord in its position with respect to said heddles.

17. A heddle frame arrangement according to claim 1, wherein said heddles each have an additional lower eyelet; and wherein said first securement means includes a rod received through said lower heddle eyelets, said rod being also secured laterally in said vertically aligned guide means against a movement out of coplanar relation to said frame.

* * * * *